US010342399B2

(12) United States Patent
Och

(10) Patent No.: US 10,342,399 B2
(45) Date of Patent: Jul. 9, 2019

(54) MOUNTING DEVICE

(71) Applicant: Indesas Sarl, Montreux (CH)

(72) Inventor: Mathias Och, Montreux (CH)

(73) Assignee: INDESAS SÀRL, Montreux (CH)

( * ) Notice: Subject to any disclaimer, the term of this patent is extended or adjusted under 35 U.S.C. 154(b) by 348 days.

(21) Appl. No.: 15/323,712

(22) PCT Filed: Jul. 2, 2015

(86) PCT No.: PCT/EP2015/065122
§ 371 (c)(1),
(2) Date: Apr. 4, 2017

(87) PCT Pub. No.: WO2016/001371
PCT Pub. Date: Jan. 7, 2016

(65) Prior Publication Data

US 2017/0231443 A1 Aug. 17, 2017

(30) Foreign Application Priority Data

Jul. 4, 2014 (EP) ..... 14175761

(51) Int. Cl.
*A47K 13/26* (2006.01)

(52) U.S. Cl.
CPC ..... *A47K 13/26* (2013.01)

(58) Field of Classification Search
CPC ..... A47K 13/02; A47K 13/12; A47K 13/24; A47K 13/26; A47K 13/28
See application file for complete search history.

(56) References Cited

U.S. PATENT DOCUMENTS 4,820,096 A 4/1989 Knight
5,711,645 A * 1/1998 Sanbonmatsu ..... F16B 37/0864 411/267

(Continued)

FOREIGN PATENT DOCUMENTS

DE 4419469 12/1995
DE 29804519 6/1998

(Continued)

OTHER PUBLICATIONS

International Search Report dated Jan. 9, 2015 in PCT/EP2015/065122.

*Primary Examiner* — Daniel J Wiley
(74) *Attorney, Agent, or Firm* — Medler Ferro Woodhouse & Mills PLLC

(57) ABSTRACT

The invention relates to a mounting device for fastening a toilet seat set to a toilet bowl in a reversibly releasable manner, comprising a connecting segment which can be connected to the toilet seat set in a stationary manner, and a rod segment, which is arranged on the connecting segment and which can be fed at least partially through a mounting opening of the toilet bowl. Furthermore, the mounting device has a deformable blocking part, which is fastened to the rod segment (12) at a distance from the connecting segment, wherein the connecting segment and the blocking part can be arranged on opposite sides of the mounting opening when the rod segment is at least partially fed through the mounting opening of the toilet bowl. The mounting device is equipped with an actuating lever, which has a clamping position, in which the blocking part is deformed in such a way that the blocking part cannot be fed through the mounting opening, and a released position, in which the blocking part is deformed sufficiently little that the blocking part can be fed through the mounting opening of the toilet bowl. The rod segment is connected to the con- (Continued)

necting segment in a stationary manner in the clamping position and in a translatable manner in the released position, and the rod segment protrudes from the connecting segment at an identical predefined angle in the damping position and in the released position.

15 Claims, 6 Drawing Sheets

(56) References Cited

U.S. PATENT DOCUMENTS

| | | | | |
|---|---|---|---|---|
| 2010/0125935 | A1* | 5/2010 | Leibfried | A47K 13/26 4/240 |
| 2014/0196204 | A1* | 7/2014 | Ayer | A47K 13/26 4/242.1 |
| 2014/0259339 | A1* | 9/2014 | Rubio | A47K 13/26 4/240 |

FOREIGN PATENT DOCUMENTS

| | | | | |
|---|---|---|---|---|
| DE | 29804519 | U1 * | 7/1998 | A47K 13/26 |
| EP | 0320569 | | 6/1989 | |
| EP | 0480534 | | 4/1992 | |
| WO | WO-2007099739 | A1 * | 9/2007 | A47K 13/26 |
| WO | WO-2012125535 | A2 * | 9/2012 | A47K 13/12 |

* cited by examiner

MOUNTING DEVICE

TECHNICAL FIELD

The invention relates to a mounting device according to the preamble of independent claim 1.

Such mounting devices include, for example, a connecting segment which can be connected in a stationary manner to a toilet seat set, a rod segment which is arranged on the connecting segment and can be fed at least partially through a mounting opening of a toilet bowl, a deformable blocking part which is fastened to the rod segment at a distance from the connecting segment, wherein the connecting segment and the blocking part can be arranged on opposite sides of the mounting opening when the rod segment is at least partially fed through the mounting opening of the toilet bowl, and an actuating lever which has a clamping position in which the blocking pat is deformed in such a way that the blocking part cannot be fed through the mounting opening, and a released position in which the blocking part is deformed sufficiently little that the blocking part can be fed through the mounting opening of the toilet bowl. They can be used for fastening the toilet seat set in a reversibly releasable manner to the toilet bowl.

STATE OF THE ART

Nowadays sit-down toilets are widely used in sanitary installations. Such sit-down toilets comprise, for example, a ceramic toilet bowl and a toilet seat set. The toilet bowl generally has a top opening with an outer rim limiting it, a flush for cleaning the inside of the toilet bowl and an outlet fitted to a lower end of the toilet bowl. The toilet seat set is typically fitted with a seat ring with which the rim of the toilet bowl can be covered, a lid for closing the opening of the toilet bowl and a hinge. The toilet seat set is mounted at its hinge on a rear region of the rim of the toilet bowl so that the seat ring and the lid can be folded back.

For mounting the toilet seat set on the toilet bowl toilet bowls often have one or preferably two mounting openings in the rear region of the rim or on the rear rim of their openings. There are many prior art designs of mounting openings which are connected on the one hand to the toilet seat set, and on the other hand can be fastened to it via the mounting openings of the toilet bowl. For example, plastic or metal devices, which are clipped or plugged into the mounting openings, are in widespread use. Such mounting devices are often relatively unstable, so that an unintended and undesirable separation of the toilet seat set from the toilet bowl can occur. Moreover, cleaning, particularly in any zone where the toilet bowl and the toilet seat set collide in the hinge region, if often difficult. This problem occurs in particular where an undetermined public uses the toilet, such as in restaurants, hospitals and especially in public toilets.

WO 2013/003969 A2 describes this regard improved embodiments of mounting devices for toilet seat sets. For example, a mounting device comprises a lever and a rod-shaped insert member. The rod-shaped insert element is connected at its one longitudinal end via an eccentric element to the lever and at its other longitudinal end to an elastomer tube. For mounting, the insert member is fed through from above through one of the mounting openings until the elastomer tube is located on the underside of the rim of the toilet bowl. Thereafter, the lever is tilted from a vertical position to a horizontal position, wherein the eccentric element on the insert element is pulled upward. Here the elastomer tube is clamped between the insert element and a blocking element and is deformed so that it will no longer fit through the mounting opening. In this position, the mounting device is fastened to the toilet bowl.

One drawback of the mounting device described above is that it fastens the toilet seat set to the bowl in a fixed position and alignment. It may therefore happen that the seat ring of the toilet seat does not lie flush against the rim of the toilet bowl, but projects somewhat obliquely from it. In the case of such mounting devices the toilet seat set must also be mounted slightly upstream so that the levers can be operated from behind. This requires either a narrow structure in the hinge region of the toilet seat set or a wide rear rim of the toilet bowl.

The object of the following invention is therefore to propose a mounting device, with which a toilet seat set can be aligned with the toilet bowl or whose position can be adapted to the toilet bowl. In addition, the mounting device should preferably avoid the need for taking special precautions on one rim of the toilet bowl or on the toilet seat set so that the mounting device can be operated.

SUMMARY OF THE INVENTION

The object is achieved by a mounting device, as defined in independent claim 1, as well as by a toilet, as defined in independent claim 11. Advantageous embodiments of the inventive mounting device result from the dependent claims.

Embodiments of the present invention are directed to a mounting device for fastening in a reversibly releasable manner a toilet seat set to a toilet bowl comprises a connecting segment which can be connected in a stationary manner to the toilet seat set and a rod segment arranged on the connecting segment, which rod segment can be fed at least partially through a mounting opening of the toilet bowl. Furthermore, the mounting device has a deformable blocking part which is arranged at a distance from the connecting segment on the rod segment, wherein the connecting segment and the blocking part can be arranged on opposite sides of the mounting opening when the rod segment is at least partially fed through the mounting opening of the toilet bowl. The mounting device is equipped with an actuating lever which can be moved from a clamping position of the mounting device, in which the blocking part is deformed in such a way that it cannot be fed through the mounting opening, into a released position of the mounting device, in which the blocking part is deformed sufficiently little that it can be fed through the mounting opening of the toilet bowl, then moved back. Here the rod segment is connected in a stationary manner in the clamping position, and displaceably in the released position, to the connecting segment, and the rod segment protrudes from the connecting segment at a preferably identical predefined angle in the clamping position and in the released position.

In the context of the invention the term "toilet" is understood to mean a sanitary seat device for receiving bodily waste, in particular faeces and urine. The term is used synonymously with the terms "loo", "lavatory", "privy" or "WC" Often toilets comprise a toilet bowl of a ceramic material such as porcelain, a flushing device for flushing the toilet bowl and a seat ring, consisting of a plastic or wood material, for example, for covering a rim of the toilet bowl.

The term "reversibly releasable" refers, in connection with the toilet seat set and the toilet bowl, to the fact that the toilet seat can be detached several times or repeatedly from the toilet bowl. In other words, the mounting device can be provided so that the toilet seat set is randomly mounted on the toilet bowl and is again detached or dismantled from it.

The toilet seat set typically comprises a seat ring of the type described above and a folding mechanism, such as one or more hinges. When the toilet seat set is fastened to the toilet bowl the seat ring can, by means of the folding mechanism, be folded up from the toilet bowl and folded down on to it. The toilet seat set may also comprise a toilet seat that can be folded up from and down on to the toilet bowl in the same way as the seat ring. The toilet lid serves to cover the toilet bowl or its opening for hygienic reasons.

Typically, the toilet seat set is fastened to the toilet bowl with a mounting set comprising two mounting devices. As a result, the toilet seat set is fastened sufficiently stable and such that it cannot be twisted.

The term "stationary", referring to the connection of the rod segment and the connecting segment, may relate to an essentially stationary arrangement of the two parts to each other. In particular, the rod segment may be connected in a stationary manner to the connecting segment in such a manner that it can neither be tilted nor displaced relative to the connecting segment. Twisting of the rod segment relative to the connecting segment, particularly about the longitudinal axis of the rod segment, may still be possible, however. In this case, twisting of the rod segment in the clamping position is only possible by applying a reasonable force, for example by means of the actuating lever.

In relation to the connection between the toilet seat set and connecting segment, the term "stationary" may also refer to the fact that the toilet seat set cannot be removed from the connecting segment. However, in relation to the connecting segment it may still be tiltable, foldable or twistable.

The term "non-rotatable", in the context of the invention, refers to a connection in which the connected parts are twisted together. They can be flexible for other movements such as longitudinal movement.

When the fastening device is arranged on the toilet bowl so that the rod segment is fed through the mounting opening and the blocking part is arranged and deformed on the side of the mounting opening opposite the connecting segment, the mounting device enables the toilet seat set to be fastened efficiently and sufficiently firmly to the toilet bowl. This can guarantee, in particular, that the toilet seat set has sufficient resistance to a shear force. For example, shear forces to which toilet lid sets on toilets can be exposed without deterioration are defined in standards such as those issued, among other things, by the German Institute for Standardisation. For example, standards are known in which these shear forces are set to 300 Newtons. The inventive mounting device is able to efficiently to meet such safety-relevant requirements.

By ensuring that the rod segment protrudes at a preferably identical predefined angle from the connecting segment, its exact predefined alignment can be achieved. For example, it can then be easily positioned in a vertical position and inserted comparatively easily into the mounting opening of the toilet bowl. In the released position is therefore only displaceable along the connecting segment. If the fixture is e inserted into the mounting opening of the toilet bowl, as intended, but is still in the released position, this has the effect that the connecting segment, and together with it the toilet seat set, can be displaced along the top of its rim. This enables the toilet seat set to be accurately positioned and aligned.

If the toilet seat set is located in a target position or alignment, the actuating lever is manually operated and the mounting device is moved to the clamping position. In this case, the blocking part is deformed so that it no longer fits through the mounting opening of the toilet bowl. The blocking part may be made for example of a thermoplastic material or a polyurethane. In this clamping position the toilet seat set is on the one hand firmly attached to the toilet bowl and on the other hand accurately positioned and aligned on it.

The connecting segment preferably comprises an essentially flat contact surface with a guide slot, the rod segment protruding through the contact surface via the guide slot.

The contact surface may be designed to rest on the rim of the toilet bowl when the rod segment is fed through the mounting opening. This enables the toilet seat set to rest cleanly and precisely on the toilet bowl. In turn the guide slot enables the toilet seat set to be moved to a certain extent so that the toilet seat set can be positioned and aligned as efficiently as possible.

Here the mounting device preferably comprises a rod segment sleeve extending non-rotatably from the guide slot of the contact surface of the connecting segment, wherein the rod segment protrudes through the rod segment sleeve and is rotatable in it. A metal tube or a tube segment, for example, may be used as the rod segment sleeve. The rod segment sleeve may be movable or displaceable, by a suitable design of one of its longitudinal ends, non-rotatably yet movably along the slot, relative to the guide slot and hence relative to the connecting segment for example, the longitudinal end may have an asymmetrical or elongated shape, so that the longitudinal end lies in the guide slot without being able to be twisted in it. The rod element sleeve provides guidance of the rod segment of the rod segment for a longitudinal movement and a rotational movement about the longitudinal axis.

A screen is preferably provided on the contact surface of the connecting segment. The screen enables the rod segment, and possibly also the rod segment sleeved, to be moved in a stepped manner on the connecting segment. This also enables inadvertent movement of the rod segment in the clamping position to be avoided.

Furthermore, the mounting device preferably comprises a seal which is arranged on the contact surface of the connecting segment. When fitted, the seal is located between the connecting section and the toilet bowl or its rim, and seals this region. This can prevent moisture and/or dirt from penetrating this region and extending, for example, through the mounting opening of the toilet bowl.

Preferably the rod segment has a longitudinal axis and the actuating lever is connected in a non-rotatable manner to the rod segment, wherein the actuating lever can be twisted from the released position into the clamping position about the longitudinal axis of the rod segment. Here, operating the actuating lever causes the rod segment to rotate or be rotated about its longitudinal axis. The actuating lever can therefore be operated efficiently by means of a horizontal rotary movement. Among other things, this enables the actuating lever to be arranged in a space-saving and concealed manner. For example, it may be located between the toilet seat set and the toilet bowl and is difficult to see or invisible from the outside. Moreover, such a horizontally rotatable actuating lever prevents the mounting device from being displaced backwards in relation to the toilet seat set. Such a horizontally movable actuating lever and the associated clamping mechanism may also be used in embodiments of mount devices in which the rod segment is not displaced on the connecting segment.

The mounting device preferably has a pivot pit connected non-rotatably to the rod segment and a sliding bolt connected non-rotatably to the rod segment sleeve and axially movable on the rod segment sleeve, wherein the blocking part is arranged on the rod segment sleeve and the slide bolt is arranged between the pivot and the blocking part. The pivot pin can be rotated by a rotation of the rod segment, for example by means of the actuating lever with respect to the sliding bolt. In turn the slide bolt can then be moved along the rod segment sleeve away from the pivot pin and towards it. The blocking part can be squeezed or pressurised by this axial movement.

This can for example be provided at the rotating and sliding bolts, which cause a longitudinal movement of the sliding bolt during a rotational movement of the pivot pin suitable means. In this regard the pivot pin preferably has an outer contact surface facing the slide bolt and the slide bolt preferably has an inner contact surface facing the pivot pin, the outer contact surface of the pivot pin and the inner contact surface of the slide bolt lying at an identical acute angle to the longitudinal axis of the rod segment. The outer contact surface and the inner contact surface have variable acute angles to the longitudinal axis of the rod segment. They can also be designed correspondingly in a spiral shape in the direction of the circumference of the pivot pin and the slide bolt. Or they can be designed correspondingly as two or more spiral segments in a region in the direction of the circumference of the pivot pin and the slide bolt. In this case the pivot pin and the sliding bolt may each have a central opening so that the contact surfaces are each formed only in a rim region or in the region in the direction of the circumference.

The pivot pin and the slide bolt can therefore rest together on the inclined inner and outer contact surfaces to each other. Here the inner contact surface of the slide bolt and the outer contact surface of the pivot pin preferably lie in the released position of the mounting device flat against one another. If the pivot pin and the slide bolt are rotated together by operating the actuating lever, the pivot pin and the slide bolt are pushed away from each other along the inclined contact surfaces. This moves the slide bolt along the rod segment sleeve in the direction of the blocking part, thereby clamping and deforming the blocking part. In particular, the blocking part can therefore form a bead and increase its radius so that it can no longer be moved through the mounting opening.

A spacer is preferably arranged between the blocking part and the connecting segment on the rod segment sleeve. The spacer can guarantee that the blocking part is located on the other side, of the mounting opening of the toilet bowl, than that of the connecting segment when the mounting device is inserted into the mounting opening. In particular, the length of the spacer may be proportional to the thickness or strength of the toilet bowl.

Another aspect of the invention relates to a toilet with a toilet bowl, a toilet seat set and a mounting device as described above for fastening the toilet seat set on the toilet bowl in a reversibly releasable manner. The toilet seat set is connected in a stationary manner to a connecting segment of the mounting fixture. The toilet bowl has a mounting opening through which a rod segment of the mounting device arranged on the connecting segment is at least partially fed. A deformable blocking part of the mounting device, which is arranged at a distance from the connecting segment on the rod segment, is arranged on the opposite side of the mounting opening of the toilet bowl. An actuating lever of the mounting device is moved into a clamping position. The actuating lever is movable from a clamping position of the mounting device, in which the blocking part of the mounting department is deformed in such a way that it cannot be fed through the mounting opening of the toilet bowl, into a released position of the mounting opening, in which the blocking part of the mounting opening of the toilet bowl is sufficiently little deformed that it can be fed through the mounting opening of the toilet bowl, then moved back. As a result of this the blocking part of the mounting device is deformed and the mounting device is fastened, together with the toilet seat set, to the toilet bowl, wherein the rod segment of the mounting device is connected in a stationary manner to the connecting segment of the mounting device and the toilet bowl. The effects and advantages mentioned in connection with the mounting device can be achieved efficiently with the inventive toilet.

The height of the toilet, between the toilet bowl and an upper side of the toilet seat set, in a closed position, is preferably a maximum of 4 cm or a minimum of 3.5 cm. Due to the design of the mounting device in a manner described above, a relatively low overall toilet height can be achieved for the toilet seat set-mounting device composition. This is often desirable for comfort or aesthetic reasons. In particular, a design which does not exceed an overall height of 3.5 cm is desirable in many cases.

The mounting device in the toilet is preferably located underneath the toilet seat set when the toilet seat set is in a closed position. This ensures that the mounting device is protected and covered.

The toilet preferably comprises two identical mounting devices which are arranged laterally adjacent to each other. The two mounting devices, possibly together with further identical mounting devices, can then make up an assembly kit. With such multiple mounting devices, or with an assembly kit, it can be ensured that the toilet seat set is sufficiently stable and not rotatably fastened.

BRIEF DESCRIPTION OF THE DRAWINGS

Further advantageous embodiments of the invention are mentioned in the following description of embodiments based on the schematic drawing. In particular, the inventive mounting device is described in the following with reference to the attached drawings based on exemplary embodiments.

DETAILED DESCRIPTION

Figure 1:
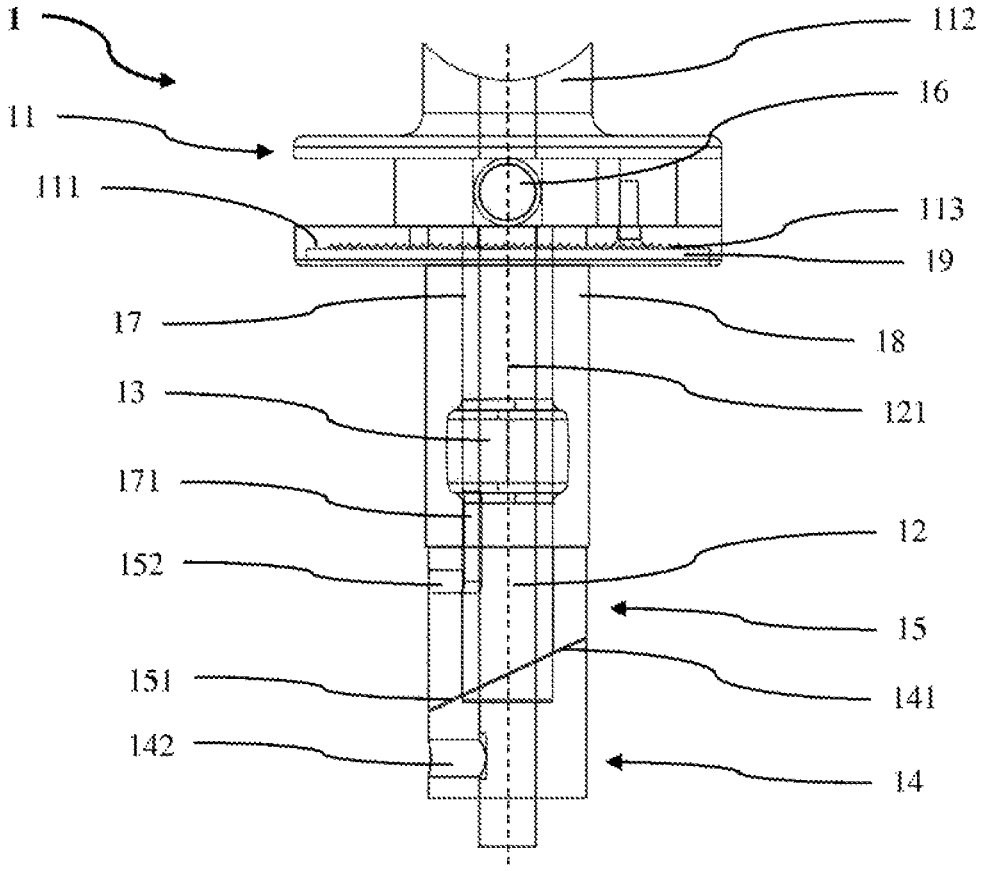
FIG. 1 shows a front view of a first embodiment of an inventive mounting device.

Certain terms are used in the following description, for practical reasons, and must not be understood to be limiting. The words "right", "left", "lower" and "upper" denote directions in the drawing to which reference is made. The terms "inward" and "outward" refer to directions toward or away from the geometric centre of the mounting device and designated parts thereof. The terminology includes the words specifically mentioned above, derivatives thereof, and words of similar import.

FIG. 1 shows a first embodiment of an inventive mounting device 1, which comprises a metal connecting segment 11, a metallic rod segment 12 having a longitudinal axis 121 and a metallic actuating lever 16. The connecting segment 11 has on an upper side connecting means 112 for connection to a toilet seat set, and on an under side a contact surface 111, on which a screen 113 is formed. Laterally contact surface 111 is limited by a rim, wherein a seal 19 of plastic is arranged inside the rim adjacent to parts of contact surface 111. The rim and contact surface 111 therefore hold seal 19.

Below a metal tubular rod segment sleeve 17 is arranged perpendicular to contact surface 111, which sleeve protrudes from rod segment 12. A blocking part 13, of an elastically deformable plastic, and a spacer 18, of a comparatively solid plastic, are slid on rod segment sleeve 17, wherein spacer 18 lies between blocking part 13 and contact surface 111 or seal 19. Below blocking part 13 rod segment sleeve 17 is equipped with a vertical guide slot 171. A fastening piston 152 of a slide bolt 15 engages in guide slot 171, which bolt is arranged underneath or on the side of blocking part 13 facing away from spacer 18 on blocking part 13 resting on rod segment sleeve 17. Rod segment sleeve 17 and slide bolt 15 are connected to each other in a non-rotatable manner via guide slot 171 and fastening piston 152, wherein slide bolt 15 is vertically displaceable on rod segment sleeve 17 over the length of guide slot 171.

A pivot pin 14 is arranged on rod segment 12 adjacent to or below slide bolt 15 against slide bolt 13. Pivot pin 14 has a screw insert 142 by means of which it is screwed to rod segment 12 in a non-rotatable manner. On its upper side piston pin 14 has an outer contact surface 14 and slide bolt 1 has an inner contact surface 151 on its underside. The outer contact surface 141 and the inner contact surface 151 have a correspondingly bevelled design so that they form an acute angle to the longitudinal axis 121 of the rod segment 12.

The following statement applies to the entire further description. If there are reference numbers in a figure to ensure greater clarity of the drawings, but if they are not mentioned in the directly associated descriptive text, reference is made to their explanation in preceding descriptions of the figures. In addition, if reference numbers which are not contained in the associated figure are mentioned in the descriptive text directly associated with a figure, reference is made to the preceding figures.

Figure 2:
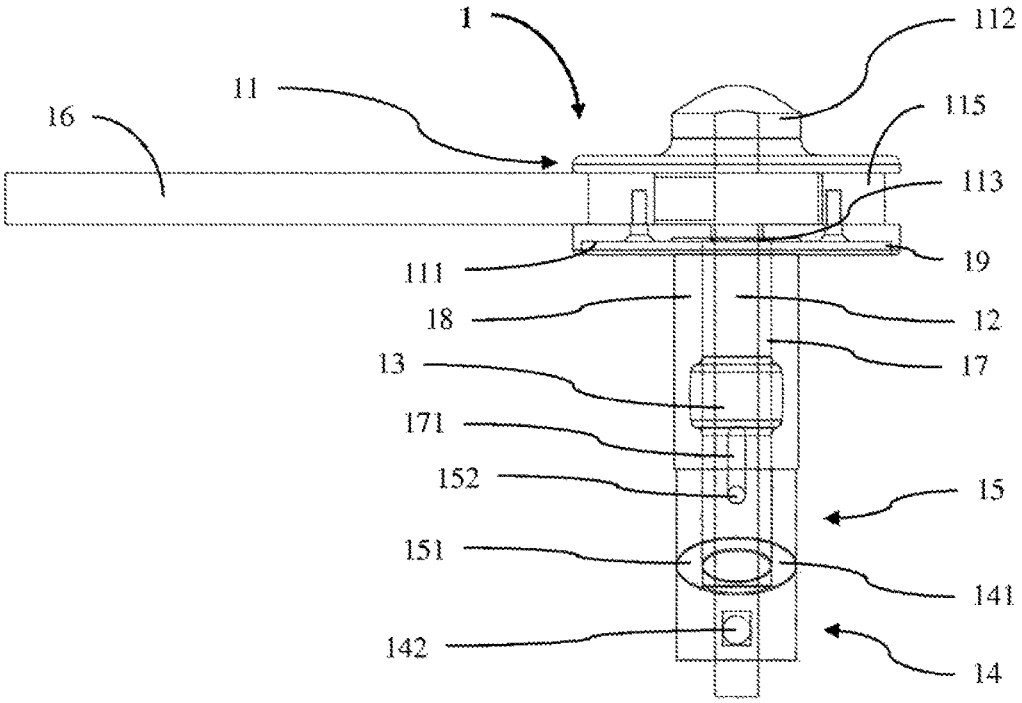
FIG. 2 shows a side view of the mounting device of FIG. 1.

Fastening device 1 in FIG. 2 is shown rotated 90° to the left about the longitudinal axis 121 of the rod segment 12 in a comparison with FIG. 1. It can be seen that actuating lever 16 is configured as a longitudinally-shaped rod which is connected centrally in connecting segment 11, in a non-rotatable manner, to rod segment 12 at a right angle. Connecting segment 11 has a lever socket 115 in which actuating lever 16 is rotatable about longitudinal axis 121 of rod segment 12. The boundaries of lever socket 115 thereby limit the radius of rotation of actuating lever 16 to 180°.

Figure 3:
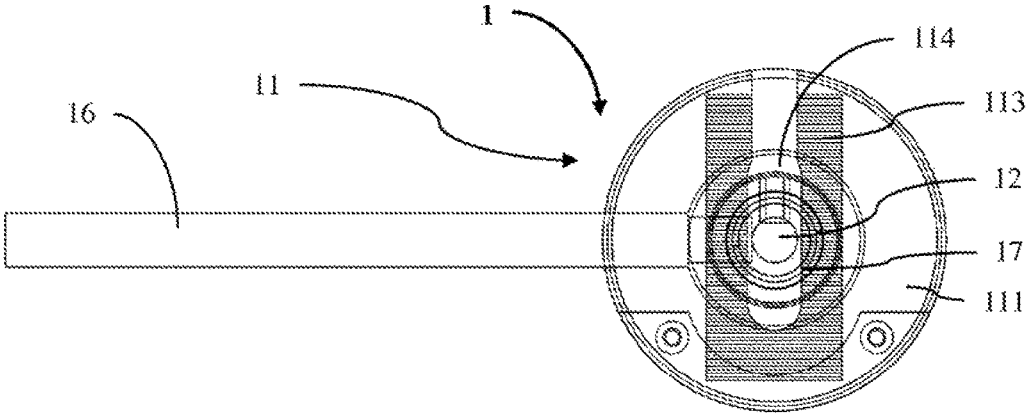
FIG. 3 shows a bottom view of the mounting device of FIG. 1.

In FIG. 3 mounting device 1 is shown from below. It can be seen that a guide slot 114, protruding from rod segment 12, is formed on contact surface 111. Moreover, a head region of rod segment sleeve 17 engages in guide slot 114, this head region being designed so that rod segment sleeve 17 is not rotatable relative to connecting segment 11 about its longitudinal axis. Thus rod segment sleeve 17 and slide bolt 15 are connected in a non-rotatable manner to the connecting segment, while rod segment 12, together with pivot pin 14 and actuating lever 16, are rotatable about longitudinal axis 121 of rod segment 12.

Figure 4:
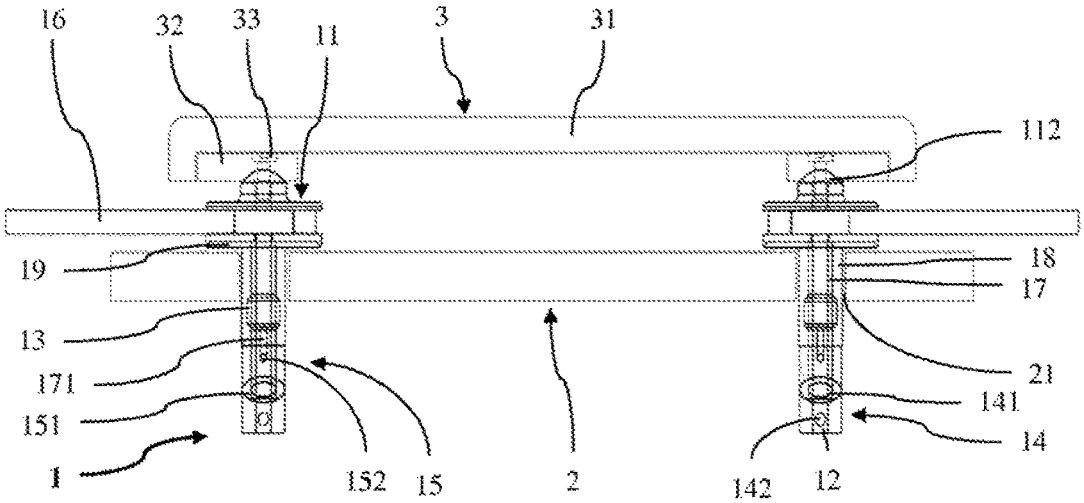
FIG. 4 shows a view of a toilet seat set installed on the toilet bowl above the mounting device of FIG. 1, the mounting device being in a released position.

FIG. 4 shows a toilet seat set 3, which is mounted on a toilet bowl 2 by means of an assembly kit with two mounting devices 1. Seat set 3 comprises a seat ring 31 and two folding hinges 32, each of which is fixedly connected to one of mounting devices 1. For this purpose folding hinges 32 are screwed with a screw 33 to connecting means 112 of connecting segment 12 of the associated mounting device 1. The mounting devices 1 are inserted through two mounting openings 21 of a rear rim of toilet bowl 2, wherein each of contact surfaces 111 of connecting segment 11 and seal 19 rests on a top of the rim and rod segment sleeve 17, together with rod segment 12, protrude through mounting opening 21. Spacers 18 of mounting devices 1 each lie inside mounting openings 21, whereas blocking parts 13, slide bolts 15 and pivot pins 14 are arranged underneath mounting openings 21 and hence underneath the rim of toilet bowl 2.

The mounting devices 1 are shown in FIG. 4 in a released position in which clamping segments 13 fit through mounting openings 21. First contact surface 141 of pivot pin 14 lies flush with second contact surface 151 of slide bolt 15. Actuating levers 16 are in their outwards maximally swiveled or rotated positions. In the released position the mounted toilet seat set 3 can be displaced along guide slots 114 of connecting segments 11 of mounting devices 1. In this manner they can be positioned and aligned, as intended, on toilet bowl 2 as prescribed.

Figure 5:
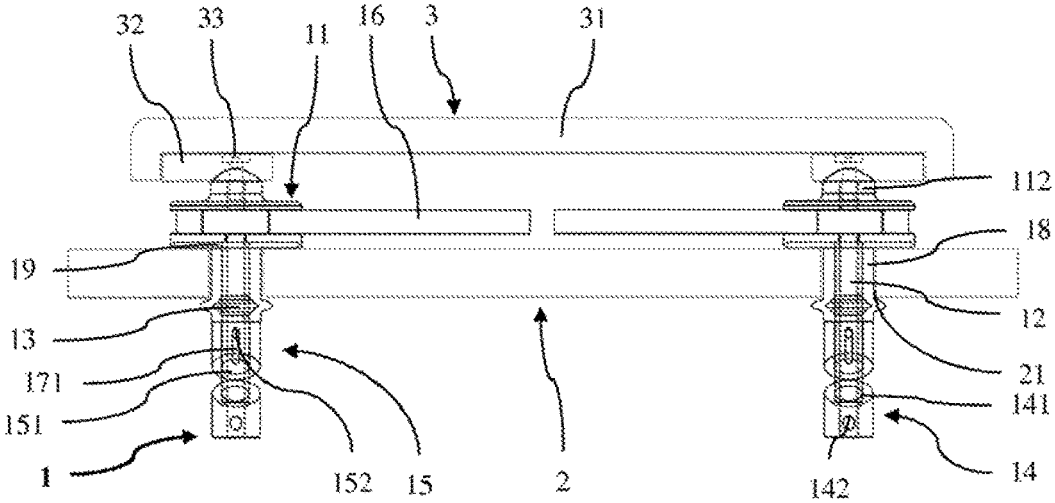
FIG. 5 shows a view of a toilet seat set installed on the toilet bowl above the mounting device of FIG. 1, the mounting device being in a clamping position.

For fixing toilet seat set 3 on toilet bowl 2 actuating levers 16 are swiveled inwards 180° about longitudinal axis 121 of rod segments 12, as shown in FIG. 5 Thereby rod segments 12 themselves, and together with them pivot pins 14, are rotated 180° about longitudinal axis 121. Since slide bolts 15 are not rotatable, the first and second contact surfaces 141, 151 no longer lie flush against each other but lie on their bottommost and uppermost sections, respectively. In this way slide bolts 15 are forced upwards during the rotary movement of pivot pins 14, and blocking parts 13 are clamped between slide bolts 15 and spacers 18. In this case, blocking parts 13 deform so that they no longer fit through mounting openings 21 of toilet bowl 2. Toilet seat set 3 is then fixedly mounted on toilet bowl 2.

At the same time a pressure is exerted on rod segment sleeves 17 by the displacement or longitudinal movement of slide bolts 15 and by the deformation of blocking parts 13, and these sleeves are pressed against connecting segments 11. Moreover, rod segments 12 are no longer displaceable toward connecting segments 11 due to screens 113. Toilet seat set 3 is in this way fixed in the aligned and positioned position.

Figure 6:
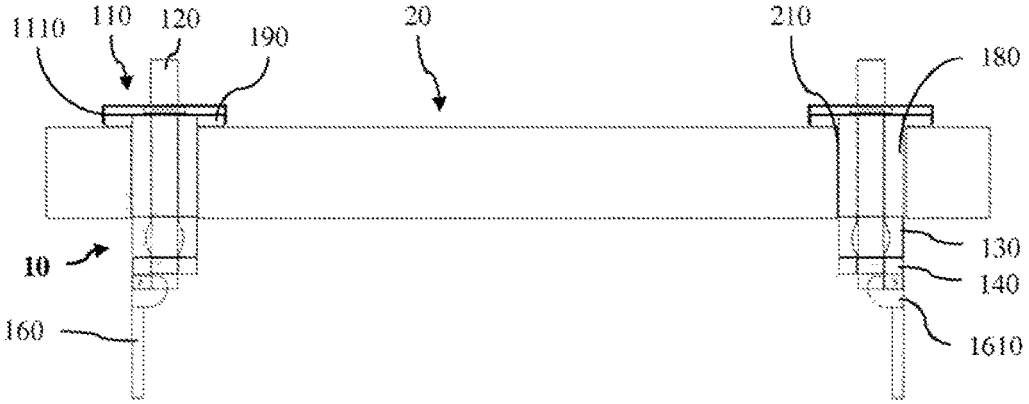
FIG. 6 is a view of a toilet seat set mounted on a toilet bowl by means of a second embodiment of an inventive mounting device, the mounting device being in a released position.

FIG. 6 shows a second embodiment of an inventive mounting device 10, which comprises a metal connecting segment 110, a metal rod segment 120 and a metal actuating lever 160. Connecting segment 110 has connecting means for connecting to a toilet seat set and a contact surface 1110 on one underside. Laterally contact surface 1110 is bounded by a rim, wherein a seal 190 of plastic is arranged inside the rim flush to parts of contact surface 1110. The rim and contact surface 1110 therefore retain seal 190.

Rod segment 120 protrudes through connecting segment 110 and can be moved axially relative to connecting segment 110. A tubular sleeve shaped spacer 180 is adjacently arranged underneath connecting segment 110 perpendicularly to contact surface 1110, rod segment 120 protruding through the spacer. On rod segment 120, below spacer 180, a plate 140 is fastened in a stationary manner to rod segment 120, wherein a blocking part 130 of an elastically deformable plastic arranged between plate 140 and spacer 180. The longitudinal end of rod segment 120, facing away from connecting segment 110, is connected by an eccentric element 1610 to actuating lever 160.

A toilet bowl 20 has on its rear rim two mounting openings 210, through each of which protrudes one of two identical mounting devices 10. In this case spacers 180 are located in mounting openings 210. Connecting segments 110 lie on the rim of toilet bowl 20 and blocking parts 130, as well as actuating levers 160, lie on a lower inside of toilet bowl 20.

Mounting devices 10 are located in FIG. 6 in a released position in which actuating levers 160 project perpendicularly from rod segments 120. In this position mounting devices 10 can be guided out of mounting holes 210 and inserted. Moreover, they can be displaced on the rim.

Figure 7:
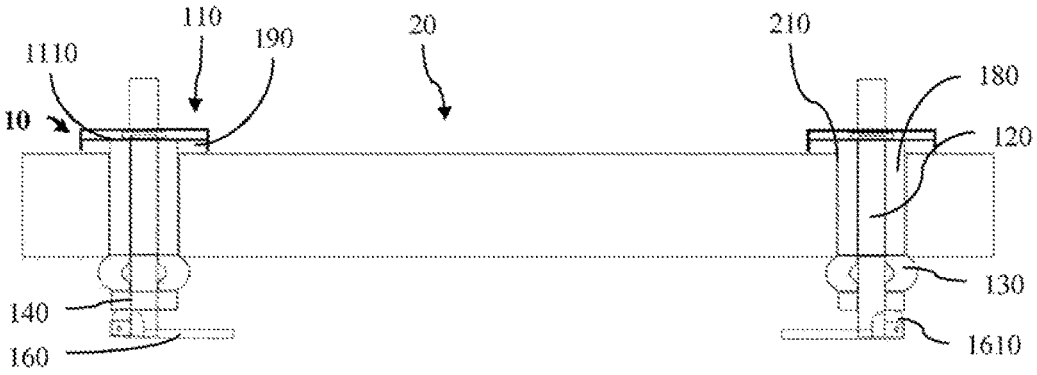
FIG. 7 is a view of the toilet seat set mounted on the toilet bowl by means of the mounting device of FIG. 6, the mounting device being in a clamping position.

As shown in FIG. 7 actuating levers 160 are folded 90° upwards into a horizontal position for fixing mounting devices 10. A pressure is exerted on blocking parts 130 by means of eccentric elements 1610 with which actuating levers 160 are connected in an articulated manner to rod segments 120. These are therefore deformed so that they no longer fit through mounting openings 210. Mounting devices 10 are thereby fixed to toilet bowl 20.

Figure 8:
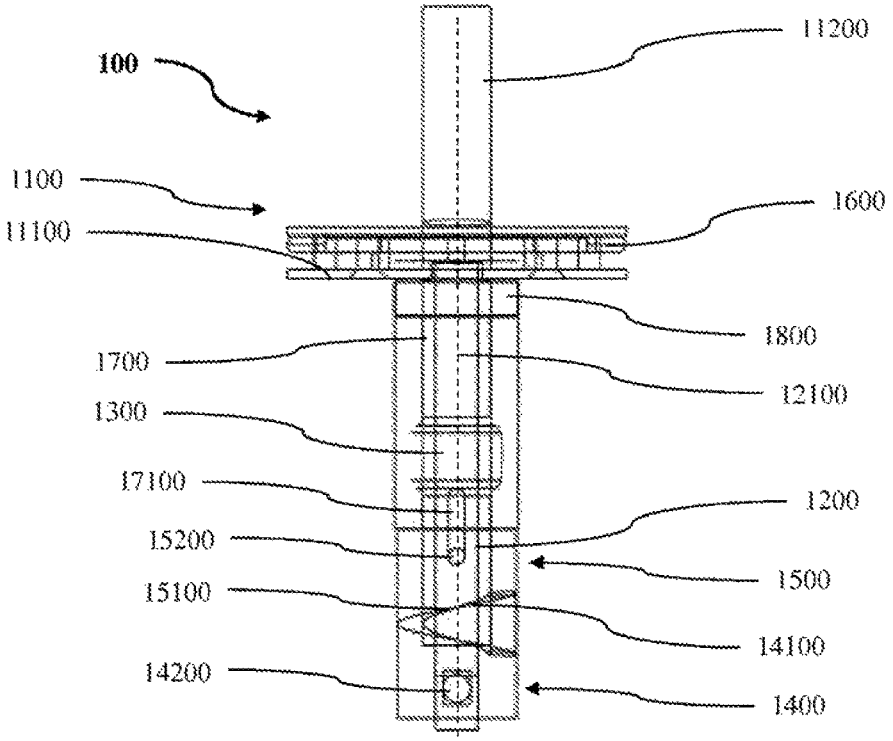
FIG. 8 shows a side view of a third embodiment of an inventive mounting device with retracted actuating lever.

FIG. 8 shows a third embodiment of an inventive mounting device 100, which comprises a metal connecting segment 1100, a metal rod segment 1200, with a longitudinal axis 1100, and a metal actuating lever 1600. Connecting segment 1100 has on one upper side connecting means 11200 for connection to a toilet seat set and on one lower side a contact surface 11100.

An actuating lever 1600 is connected in a non-rotatable manner to connecting segment 1100. Actuating lever 1600 is almost horizontal and is shown in FIG. 8 in a retracted state. In this state, it is arranged fully within connecting segment 1100.

A metal tubular rod segment sleeve 1700, through which rod segment 1200 protrudes, is adjacently arranged underneath and perpendicular to contact surface 11100. A blocking part 1300, of an elastically deformable plastic, and a split spacer 180, of a comparatively solid plastic, are pushed onto rod segment sleeve 1700, wherein spacer 1800 lies between blocking part 1300 and contact surface 11100. Below blocking part 1300 rod segment sleeve 1700 is equipped with a vertical guide slot 17100. A fastening piston 15200 of a slide bolt 1500, which is arranged on rod segment sleeve 1700 and adjacent to blocking part 1300 and underneath or on one side of blocking part 1300 facing away from spacer 1800, engages in guide slot 17100. Rod segment sleeve 1700 and slide bolt 1500 are connected to each other in a non-rotatable manner via guide slot 17100 and fastening piston 15200, wherein slide bolt 1500 is vertically displaceable on rod segment sleeve 1700 along the length of guide slot 17100.

A pivot pin 1400 is arranged on rod segment 1200 on slide bolt 1500 against blocking part 1300 adjacent to or underneath slide bolt 1500. Pivot pin 1400 has a screw socket 14200 by means of which it is screwed in a non-rotatable manner to rod segment 1200. The pivot pin 1400 has an outer contact area 14100 on its upper side and the slide bolt 1500 has an inner contact area 15100 on its underside. The outer contact area 14100 and the inner contact surface 15100 are correspondingly bevelled and designed bent so that they form, over a wide extent, an acute angle with the longitudinal axis 12100 of the rod segment 1200.

Figure 9:
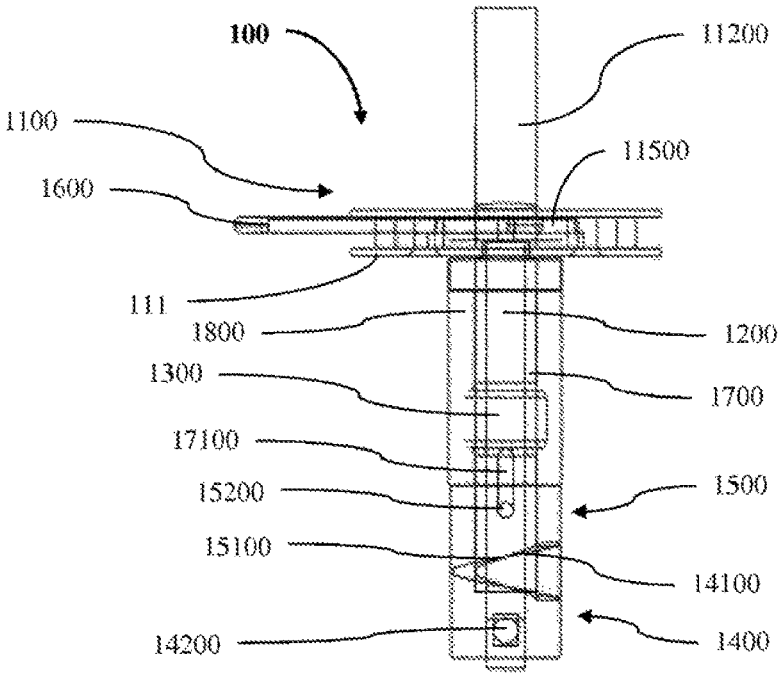
FIG. 9 shows a side view of the mounting device of FIG. 8 with extended actuating lever.

In comparison with FIG. 8, the fixation device 100 is shown in FIG. 9 with the actuating lever 1600 in the extended state. In this state, the actuating lever 1600 is pushed out horizontally to the left from the connecting segment 1100. Consequently, it is accessible from outside of the connecting segment 1100 and can be easily operated. Also, it is evident that the actuating lever 1600 is rod-shaped and forms a right angle with the rod segment 1200. The connecting segment 1100 comprises a lever socket 11500, in which the actuating lever 1600 may be displaced horizontally.

Figure 10:
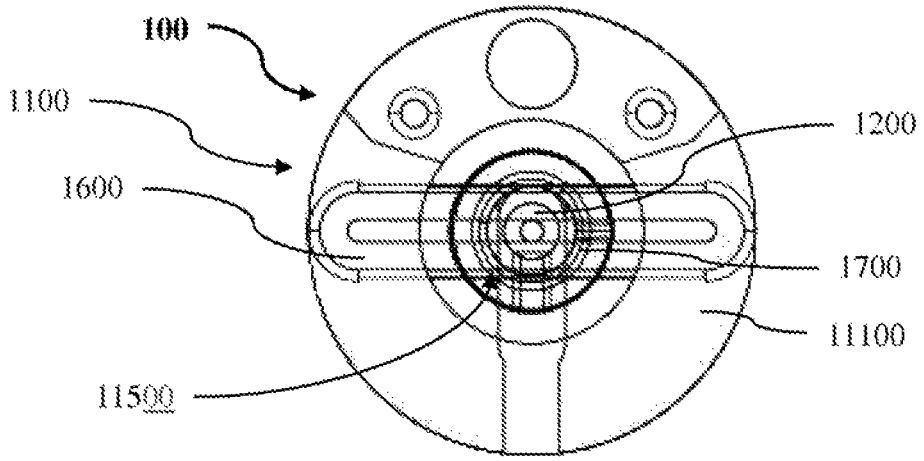
FIG. 10 shows a plan view of the mounting device of FIG. 8 with retracted actuating lever.

In FIG. 10 the mounting device 100 is shown from above. It is thereby apparent that actuating lever 1600 has a central vertical slot, which is penetrated by a bolt of lever socket 11500. The bolt of lever socket 11500 lies centrally in connecting segment 1100. In addition, the lever socket 11500 has a guide groove which receives actuating lever 1600 and supports it laterally.

Figure 11:
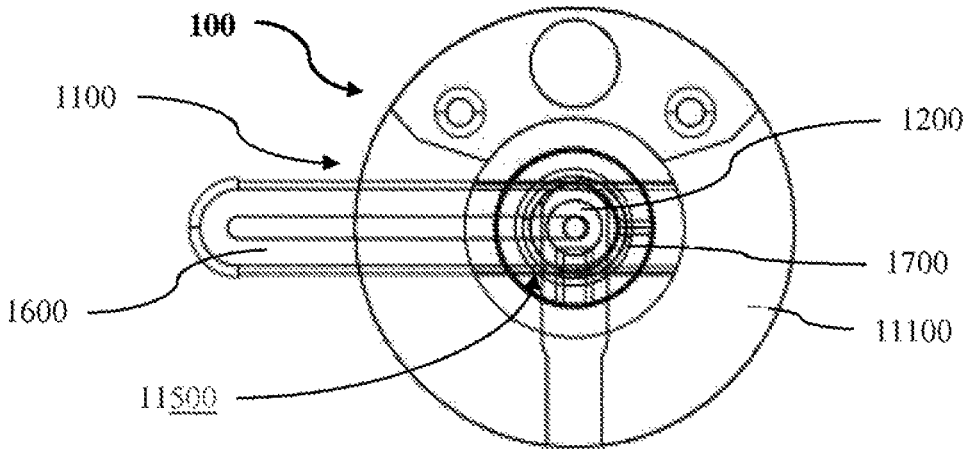
FIG. 11 shows a plan view of the mounting device of FIG. 8 with extended actuating lever.

As shown in FIG. 11, actuating lever 1600 is radially extendible to the left along the guide groove until the end of the vertical slot abuts against the bolt of lever socket 11500. The slot of actuating lever 1600, together with the bolt of lever socket 11500, limit the radial movement of actuating lever 1600. As shown in FIG. 11, actuating lever 1600 may be extended both to the left and in an analogous manner to the right.

The guide groove of lever socket 11500 receives a rotary or tangential movement of actuating lever 1600 and transmits the rotary motion to rod segment 1200. As a result, rod segment 1200 can be rotated by a rotation of actuating lever 1600, and mounting device 100 is therefore brought from a clamping position to a released position, and vice versa. Using the retractability and extendibility of actuating lever 1600 said device can be extended, if needed, for actuation of mounting device 100, and can otherwise be provided in connecting segment 1100. Therefore, no interfering part projects from the connecting segment when no actuation of mounting device 100 is required.

Although the invention is represented by means of the figures and associated specification, and is described in detail, this representation and this detailed description, it is understood that persons skilled in the art may make changes and modifications without departing from the scope of the following claims. The present disclosure also includes embodiments with any combination of features which are mentioned or shown above or in the following in regard to different embodiments. It also includes individual features in the figures, even if they are shown therein in conjunction with other features and/or are not mentioned above or in the following. The alternatives of embodiments described in the figures and in the specification, and individual alternatives whose features are excluded from the object of the invention or from the disclosed objects, may also be included. The disclosure includes embodiments which exclusively comprise the features described in the claims or in the exemplary embodiments as well as those which include other additional features.

Furthermore, the term "include" and derivations thereof does not exclude other elements or steps. Also, the indefinite article "a" or "an" and derivatives thereof does not exclude a plurality. The functions of several features listed in the claims can be performed by one unit or one step. The terms "essentially", "about", "approximately", and the like in connection with a feature or a value also define, in particular, the exact feature or the exact value. The terms "about" and "approximately" in the context of a given numerical value or range may refer to a value or range that is within 20%, within 10%, within 5% or within 2% of the given value or range. All reference signs in the claims are not to be understood as limiting the scope of the claims.

What is claimed is:

1. A mounting device for reversibly releasable fastening a toilet seat set on to a toilet bowl, comprising a connecting segment, which can be connected in a stationary manner to the toilet seat set, a rod segment which is arranged on the connecting segment and which can be fed at least partially through a mounting opening of the toilet bowl, a deformable blocking part which is arranged at a distance from the connecting segment on the rod segment, wherein the connecting segment and the blocking part can be arranged on opposite sides of the mounting opening of the toilet bowl when the rod segment is at least partially fed through the mounting opening of the toilet bowl, a spacer arranged on the rod segment and configured to extend through the mounting opening of the toilet bowl, wherein the spacer has a length configured to be substantially equal to a depth of the mounting opening of the toilet bowl, and wherein an upper end of the spacer contacts the connecting segment, and the lower end of the spacer contacts the blocking part, and an actuating lever connected to the rod segment that can be moved from a clamping position of the mounting device, in which the blocking part is compressed from below so as to be deformed in such a manner that it cannot be fed through the mounting opening of the toilet bowl, into a released position of the mounting device, in which the blocking part is sufficiently little deformed that it can be fed through the mounting opening of the toilet bowl, then moved back, wherein the rod segment is connected to the connecting segment in the clamping position in a stationary manner and in the released position in a displaceable manner relative to the connecting segment, and wherein the rod segment projects from the connecting segment at a predefined angle in the clamping position and in the released position.

2. The mounting device according to claim 1, in which the connecting segment comprises an essentially flat contact surface with a guide slot, wherein the rod segment penetrates the contact surface through the guide slot.

3. The mounting device according to claim 2, which comprises a rod segment sleeve extending in a non-rotatable manner from the guide slot of the contact surface of the connecting segment, wherein the rod segment penetrates the rod segment sleeve and is rotatable in it.

4. The mounting device according to claim 3, which comprises a pivot pin connected in a non-rotatable manner to the rod segment and a slide bolt that is connected in a non-rotatable manner to the rod segment sleeve and movable axially on the rod segment sleeve, wherein the blocking part is arranged on the rod segment sleeve and the slide bolt is arranged between the pivot pin and the blocking part.

5. The mounting device according to claim 4, in which the pivot pin has an outer contact surface facing towards the slide bolt and the slide bolt has an inner contact surface facing towards the pivot pin, wherein the outer contact surface of the pivot pin and the inner contact surface of the slide bolt lie at an identical acute angle to the longitudinal axis of the rod segment.

6. The mounting device according to claim 5, wherein the inner contact surface of the slide bolt and the outer contact surface of the pivot pin lie flush to each other in the released position of the mounting device.

7. The mounting device according to claim 2, wherein a screen is formed on the contact surface of the connecting segment.

8. The mounting device according to claim 7, which comprises a seal which is arranged on the contact surface of the connecting segment.

9. The mounting device according to claim 1, in which the rod segment has a longitudinal axis and the actuating lever is connected in a non-rotatable manner to the rod segment, wherein the actuating lever may be rotated from the released position into the clamping position and back about the longitudinal axis of the rod segment.

10. The mounting device according to claim 9, which comprises a pivot pin connected in a non-rotatable manner to the rod segment and a slide bolt that is connected in a non-rotatable manner to the rod segment sleeve and movable axially on the rod segment sleeve, wherein the blocking part is arranged on the rod segment sleeve and the slide bolt is arranged between the pivot pin and the blocking part.

11. A toilet comprising:

a toilet bowl comprising at least one mounting opening;

a toilet seat set; and a mounting device according to claim 1;

wherein the mounting device connects the toilet seat set to the toilet bowl via the mounting opening.

12. The toilet according to claim 11 wherein a height between the toilet bowl and an upper side of the toilet seat set is a maximum of 4 cm or a minimum of 3.5 cm in a closed position.

13. The toilet according to claim 12, wherein the mounting device is located underneath the toilet seat set when the toilet seat set is in a closed position.

14. The toilet according to claim 11 wherein the mounting device is located underneath the toilet seat set when the toilet seat set is in a closed position.

15. The toilet according to claim 11 which comprises two identical mounting devices which are arranged laterally adjacent to each other.

* * * * *